US010252882B2

(12) United States Patent
Meguro et al.

(10) Patent No.: US 10,252,882 B2
(45) Date of Patent: Apr. 9, 2019

(54) ELEVATOR MOTION ALERT SYSTEM

(71) Applicant: OTIS ELEVATOR COMPANY, Farmington, CT (US)

(72) Inventors: Daisuke Meguro, Tokyo (JP); Hisanori Seki, Tomisato (JP); Keiji Hashimoto, Chiba (JP); Takayuki Suzuki, Chiba (JP)

(73) Assignee: OTIS ELEVATOR COMPANY, Farmington, CT (US)

( * ) Notice: Subject to any disclaimer, the term of this patent is extended or adjusted under 35 U.S.C. 154(b) by 53 days.

(21) Appl. No.: 15/344,626

(22) Filed: Nov. 7, 2016

(65) Prior Publication Data

US 2017/0137256 A1 May 18, 2017

(30) Foreign Application Priority Data

Nov. 17, 2015 (JP) ..... 2015-224558

(51) Int. Cl.
*B66B 3/00* (2006.01)
*B66B 5/00* (2006.01)
*G08B 21/18* (2006.01)

(52) U.S. Cl.
CPC ..... *B66B 5/005* (2013.01); *B66B 3/002* (2013.01); *G08B 21/18* (2013.01)

(58) Field of Classification Search
CPC ..... B66B 3/002; B66B 1/24; B66B 5/0093
See application file for complete search history.

(56) References Cited

U.S. PATENT DOCUMENTS 5,476,157 A 12/1995 Todaro
5,817,994 A * 10/1998 Fried ..... B66B 1/34 187/391
6,202,797 B1 * 3/2001 Skolnick ..... A41D 13/00 187/279
7,729,691 B2 * 6/2010 Newville ..... G06Q 30/0207 187/247
2001/0035315 A1 11/2001 Lindegger et al.
2003/0010576 A1 1/2003 Malone, Jr.
2004/0094366 A1 * 5/2004 Weinberger ..... B66B 5/0025 187/247
2008/0223667 A1 9/2008 Tinone et al.
(Continued)

FOREIGN PATENT DOCUMENTS

CN 203173628 U 9/2013
JP 2000086104 A 3/2000
(Continued)

OTHER PUBLICATIONS

Extended European search report for application No. 16275163.0-1731 dated Apr. 25, 2017 (8 pages).

*Primary Examiner* — Marlon Fletcher
(74) *Attorney, Agent, or Firm* — Cantor Colburn LLP

(57) ABSTRACT

An elevator motion alert system is configured to alert a person of an object moving in at least one hoistway of an elevator system. The elevator motion alert system includes a sensor configured to detect object motion. A transmitter of the elevator motion alert system is carried by the object and is configured to transmit a pressure wave at a pre-defined frequency upon movement of the object. An electronic device of the elevator motion alert system is configured to receive and process the pressure wave for alerting the person of object movement.

2 Claims, 2 Drawing Sheets

(56) References Cited

U.S. PATENT DOCUMENTS

| | | | | |
|---|---|---|---|---|
| 2011/0073416 | A1 | 3/2011 | Nowel | |
| 2011/0240414 | A1* | 10/2011 | Carreno | B66B 5/0025 187/390 |
| 2011/0278099 | A1* | 11/2011 | Kattainen | B66B 1/32 187/288 |
| 2014/0008152 | A1* | 1/2014 | Annen | B66B 5/0037 187/247 |
| 2017/0137256 | A1* | 5/2017 | Meguro | B66B 5/005 |

FOREIGN PATENT DOCUMENTS

| | | | |
|---|---|---|---|
| JP | 2003095554 | A | 4/2003 |
| JP | 2005096891 | A | 4/2005 |
| JP | 2005132543 | A | 5/2005 |
| JP | 2007284239 | A | 11/2007 |
| JP | 2010195530 | A | 9/2010 |
| JP | 2011121651 | A | 6/2011 |
| JP | 2014015300 | A | 1/2014 |
| WO | 2007018540 | A1 | 2/2007 |
| WO | 2008082380 | A1 | 7/2008 |
| WO | 2014095511 | A1 | 6/2014 |

* cited by examiner

ELEVATOR MOTION ALERT SYSTEM

CROSS-REFERENCE TO RELATED APPLICATION

This patent application claims the priority to Japanese Application Serial No. 2015-224558 filed Nov. 17, 2015, the entire contents of which is incorporated herein by reference.

BACKGROUND

The present disclosure relates to elevator systems, and more particularly to an elevator motion alert system.

Elevator systems exist in many different configurations. One of the more traditional configurations is known as a roped elevator system where an elevator car is suspended by a cable and a pulley system for vertical movement in a hoistway. Counterweight(s) associated with the same cable and/or pulley system may assist in the upward motion of the elevator car. Other elevator systems have recently been proposed that may include multiple elevator cars in a single hoistway, and/or multiple elevator cars moving within and between multiple hoistways. In such systems, the elevator cars may generally be ropeless and propelled by linear motors.

Regardless of the elevator system configuration, all systems require maintenance and/or inspections that may require maintenance personnel to enter the confined environment of the hoistway. The movement of elevator cars while maintenance personnel are in the hoistway is not desirable, thus a variety of safety procedures, policies and devices may exist to prevent injury. Accentuating safety and/or communication is desirable.

SUMMARY

An elevator car motion alert system for signaling motion of at least one elevator car to a person according to one, non-limiting, embodiment of the present disclosure includes a sensor configured to detect car motion; a transmitter configured to transmit a pressure wave at a pre-defined frequency upon movement of the elevator car detected by the sensor; and an electronic device configured to receive and process the pressure wave for alerting the person of the movement of the elevator car.

Additionally to the foregoing embodiment, the electronic device is a smartphone.

In the alternative, or additionally thereto, in the foregoing embodiment, the electronic device is a cellular telephone.

In the alternative, or additionally thereto, in the foregoing embodiment, the pressure wave is not audible.

In the alternative, or additionally thereto, in the foregoing embodiment, the pressure wave has a frequency of about greater than 17 kHz.

In the alternative, or additionally thereto, in the foregoing embodiment, the electronic device includes a microphone for receipt of the pressure wave.

In the alternative, or additionally thereto, in the foregoing embodiment, the elevator car motion alert system includes a plurality of motion sensors, wherein each one is carried by a respective elevator car of the at least one elevator car; and a plurality of transmitters, wherein each one is carried by a respective elevator car of the at least one elevator car, and each transmitter broadcasts a pressure wave having a unique frequency specific to each one of the at least one elevator car.

In the alternative, or additionally thereto, in the foregoing embodiment, the electronic device is configured to recognize each one of the unique frequencies and assign the unique frequencies to respective elevator cars.

In the alternative, or additionally thereto, in the foregoing embodiment, the pressure wave includes a DTMF communication protocol.

A method of operating an elevator car motion alert system according to another, non-limiting, embodiment includes moving an elevator car within a hoistway; detecting the movement by a sensor associated with the elevator car; sending a signal indicative of motion to a transmitter; broadcasting a pressure wave by the transmitter; detecting the pressure wave by an electronic device; and initiating an alert by the electronic device.

Additionally to the foregoing embodiment, the electronic device is mobile.

In the alternative, or additionally thereto, in the foregoing embodiment, the electronic device is a smartphone.

In the alternative, or additionally thereto, in the foregoing embodiment, the pressure wave is broadcasted within the hoistway.

In the alternative, or additionally thereto, in the foregoing embodiment, the pressure wave is one of a plurality of pressure waves each broadcasting at a unique frequency that is specific to a respective elevator car of a plurality of elevator cars.

In the alternative, or additionally thereto, in the foregoing embodiment, the pressure wave has a frequency of about greater than 17 kHz.

An elevator motion alert system for alerting a person of an object moving in at least one hoistway according to another, non-limiting, embodiment includes a transmitter configured to transmit a pressure wave at a pre-defined frequency upon movement of the object; and an electronic device configured to receive and process the pressure wave for alerting the person of object movement.

Additionally to the foregoing embodiment, the object is an elevator car.

In the alternative, or additionally thereto, in the foregoing embodiment, the object is a counterweight.

In the alternative, or additionally thereto, in the foregoing embodiment, the object is a door.

In the alternative, or additionally thereto, in the foregoing embodiment, the electronic device has DTMF capability.

The foregoing features and elements may be combined in various combinations without exclusivity, unless expressly indicated otherwise. These features and elements as well as the operation thereof will become more apparent in light of the following description and the accompanying drawings. However, it should be understood that the following description and drawings are intended to be exemplary in nature and non-limiting.

BRIEF DESCRIPTION OF THE DRAWINGS

Various features will become apparent to those skilled in the art from the following detailed description of the disclosed non-limiting embodiments. The drawings that accompany the detailed description can be briefly described as follows.

DETAILED DESCRIPTION

Figure 1:
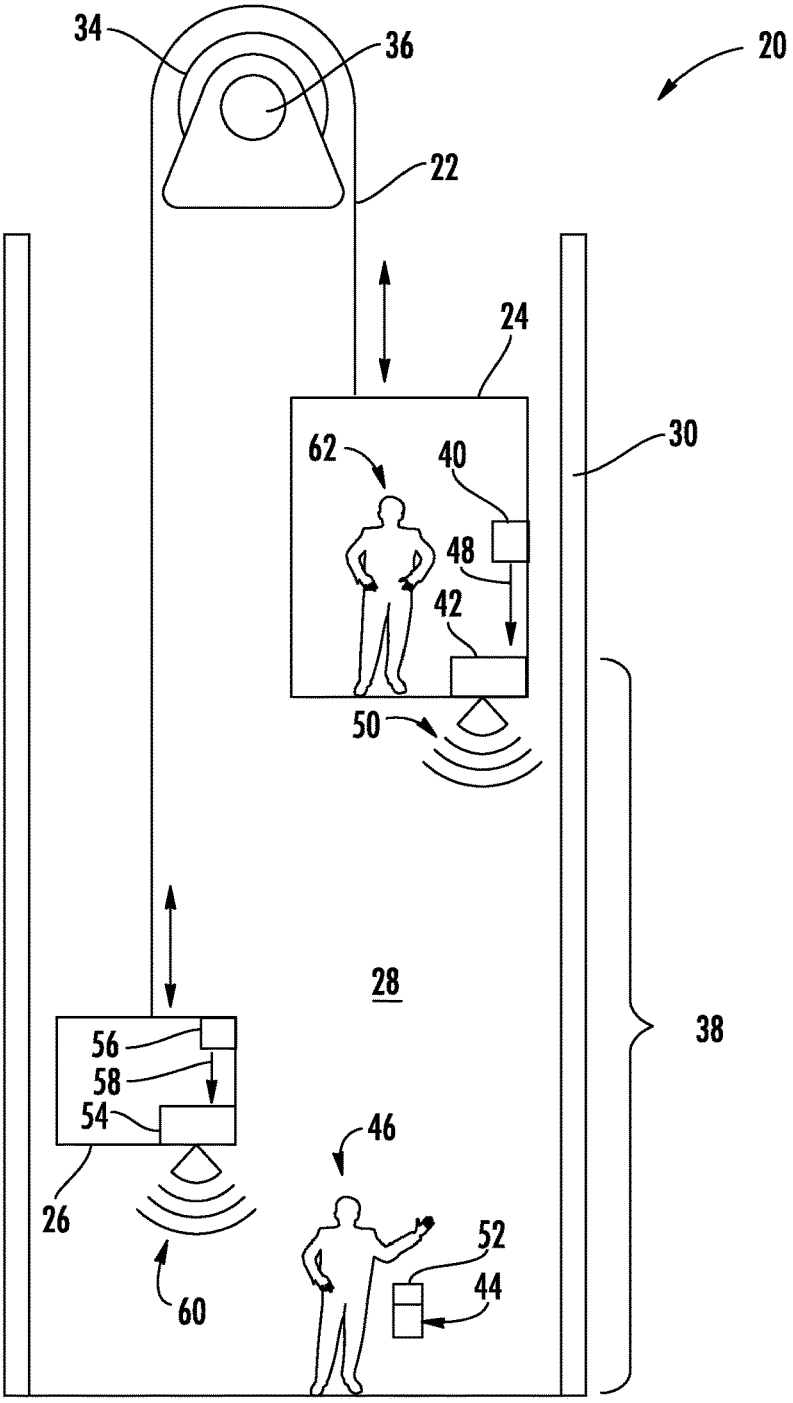
FIG. 1 is a schematic of an elevator system utilizing a motion alert system as one exemplary embodiment of the present disclosure.

Referring to FIG. 1, an exemplary embodiment of an elevator system 20 is illustrated. The elevator system 20 may include a cable 22 that extends between and is engaged to first and second objects 24, 26. The first object 24 may be an elevator car and the second object may be a counterweight. The elevator car 24 and counterweight 26 may be located and adapted to move in a hoistway 28 that may be defined by a structure 30. The cable may further wrap about a rotating sheave 34 driven by a motor 36. When the motor 36 receives a drive signal to raise the elevator car 24, the sheave is driven in a first rotational direction and the counterweight 26 lowers to assist raising of the car. When the motor 36 receives a drive signal to lower the elevator car 24, the sheave is driven in an opposite rotational direction and the counterweight 26 rises as the elevator car 24 is lowered.

The elevator system may further include a motion alert system 38. The motion alert system 38 may include a sensor 40, a transmitter 42 and an electronic device 44 that may be mobile. The sensor 40 and the transmitter 42 may be in and/or carried by elevator car 24. The electronic device 44 may be carried by a person 46 who may benefit by being alerted when movement of the elevator car 24 occurs. For example, the person 46 may be a maintenance repairman who must work within the confines of the hoistway 28 and who may benefit via knowledge of elevator car motion.

The sensor 40 detects elevator car motion and may be configured to send a motion detected signal (see arrow 48) to the transmitter 42. The transmitter 42 is configured to receive the motion detected signal 48 and broadcast a pressure wave 50 (i.e., sonic wave) that may travel at least within the hoistway 28. The electronic device 44 may include a microphone 52 adapted to receive the pressure wave 50. The pressure wave 50 may be transmitted at a pre-scribed frequency indicative of elevator car motion and recognizable by the electronic device. Upon receipt and recognition of the pressure wave 50, the electronic device 44 is configured to alert the person 46 of the elevator car 24 motion. The alert may be of any variety including, as an example, a flashing light, a vibration, an audible alert, a written alert that appears on a screen of the electronic device, or any combination thereof. It is further contemplated and understood that the sensor 40 may be configured to output a first signal indicative of upward motion and a second signal indicative of downward motion. The transmitter 42 may then output pressure waves at two different frequencies indicative of the respective upward and downward motions.

It is further contemplated and understood that the pressure wave 50 may be at a single frequency regardless of upward or downward motion. In this example, the transmitter 42 may utilize dual-tone multi-frequency (DTMF) or a Morse code (i.e. time division multiplexing) which may apply a communication protocol to individually identify the upward motion state, the downward motion state and other states.

The sensor 40 may be a dedicated component of the motion alert system 38 or may be part of the overall elevator control system (not shown) which is configured to know, for example, which elevator cars 24 are moving, in which direction, and in which of a plurality of hoistways 28. The motion detected signal 48 may be received by the transmitter 42 directly from the sensor 40 or may come elsewhere from the elevator control system. The sensor 40 may be any variety of sensors capable of detecting elevator car motion including a position sensor or an accelerometer. It is further contemplated and understood that the sensor 40 may not be in the elevator car 24 and/or may send the signal 48 wirelessly. Furthermore, the transmitter 42 may not be carried by the elevator car 24 and instead may be strategically located within the hoistway 28 and/or in a location where the pressure wave is desired to be received. Moreover, the transmitter 42 may be mounted on the top or the bottom of the elevator car 24 depending on the desired direction of the pressure wave broadcast. Yet further, each elevator car 24 may carry two transmitters for broadcasting in respective upward and downward directions. As a further example, the car 24 and the associated counterweight 26 may transmit different signals since they are moving in opposite directions.

The motion alert system 38 may include a second transmitter 54 and a second sensor 56 that may be carried by the counterweight 26. Upon a motion signal 58 from the second sensor 56, the transmitter 54 may broadcast a second pressure wave 60 in the second hoistway 32 that has a frequency different that the first pressure wave 50. The second pressure wave 60 may be received by the electronic device 44, as described above, to alert the person 46 of the counterweight motion. The electronic device 44 may be pre-programmed to recognize the difference between the two pressure waves 50, 60 and may therefore provide distinctive alerts to the person 46. The alert, for example, may serve as a safety feature if the person 46 is in the second hoistway 32. It is further contemplated and understood that other sensors and transmitters may be included to, for example, signal/alert motion of elevator doors that may indicate a second person has entered a hoistway location (e.g., second repairman).

As another example, the motion alert system 38 may be applied to a ropeless elevator system (not shown) having multiple elevator cars 24 in any one of a plurality of hoistways 28. The transmitters 42 in each elevator car 24 may broadcast pressure waves 50 that each have distinctive frequencies indicative of a particular elevator car and/or a particular hoistway. The electronic device 44 may be pre-programmed to recognize the distinctive frequencies and thus identify which elevator car 24 is in motion, in which direction, and in which hoistway. The person 46 may then be appropriately alerted.

It is further contemplated and understood that the pressure waves 50 may not be audible and/or may be greater than about 17 kHz Because the pressure waves 50 may not be audible, any passengers 62 in the elevator car(s) 24 may not be needlessly alarmed. Alternatively, the pressure waves 50 may be audible and/or may have frequencies in the range of about 20 Hz to about 17 kHz. Preferably, the broadcasting frequencies are within lower ranges to promote broadcasting at greater distances.

The electronic device 44 may be mobile and capable of being carried by the person 46 during, for example, maintenance and/or repair of the elevator system 20. The electronic device 44 may be a cellular telephone and/or a smart phone having a pre-programmed application capable of performing the frequency recognition and alert functions described above. The electronic device 44 may further include DTMF capability for recognition of the various motion states (e.g., car upward, car downward, door closing, door opening, etc.) via the pressure wave(s) 50. That is, the electronbic device 44 may respond differently to different conditions and/or moving objects (e.g., car approaching versus moving away and/or car 24 versus the counterweight 26). It is further contemplated and understood that the electronic device 44 may not be carried by the mechanic, and instead, may be mounted, for example, in the pit area of the hoistway 28.

It is further contemplated and understood, that traditional elevator controllers (not shown) include controller software that is generally the commander that commands the elevator car 24 to move. As such, the transmitter 42 (or a second transmitter) may be configured to receive signal(s) from the controller indicative of anticipated or controller elevator car motion. When such a signal is received from the elevator system controller, the transmitter 42 may emit a similar pressure wave as previously described with the sensor 40.

Figure 2:
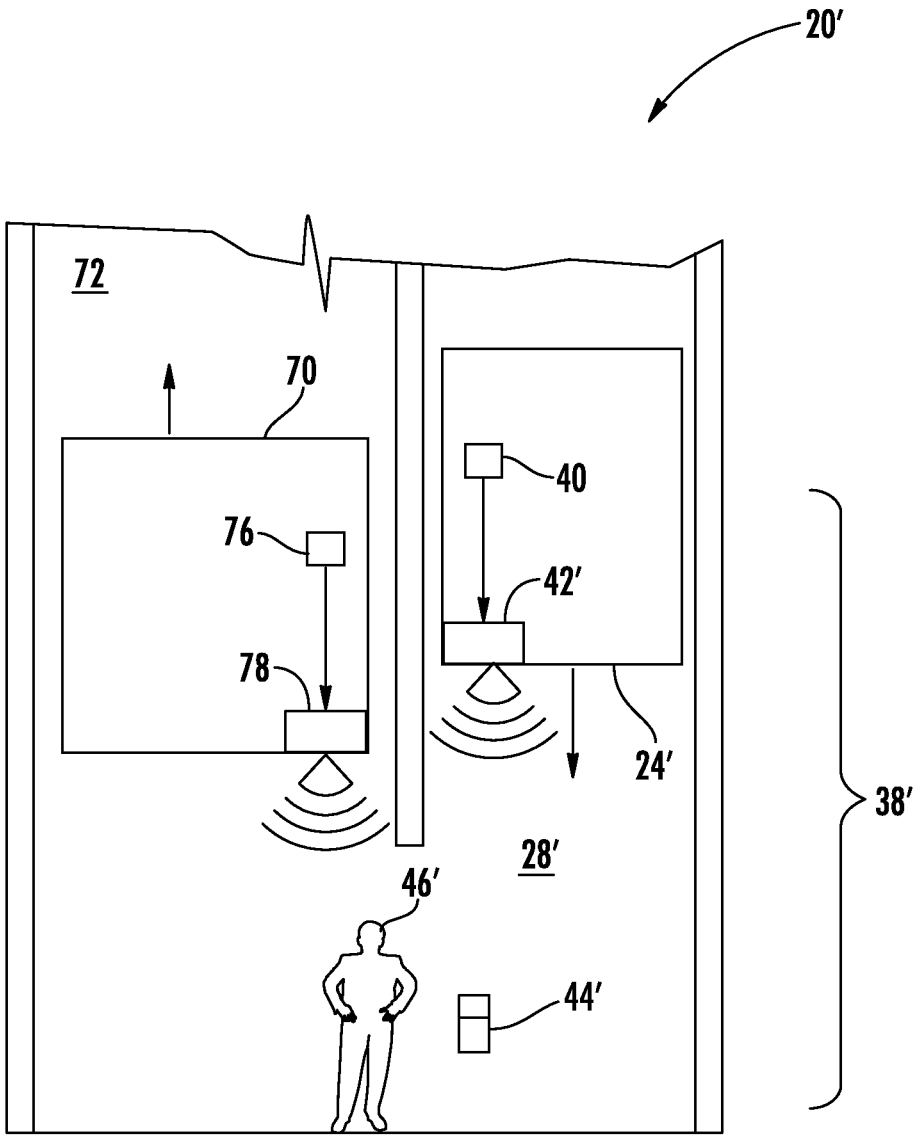
FIG. 2 is a schematic of a second embodiment of the elevator system.

Referring to FIG. 2, a second embodiment of an elevator system is illustrated wherein like elements to the first embodiment have like identifying numerals except with the addition of a prime system. The elevator system 20' includes a first elevator car 24' adapted to travel in a first hoistway 28' and a second elevator car 70 adapted to travel in a second hoistway 72. The hoistways 28', 72 may be in communication with one-another, at, for example, a pit area and such that a person or mechanic 46' may be beneath any one of the cars 24', 70 at any given moment.

A motion alert system 38' may include an electronic device 44', a sensor 40' and a transmitter 42' associated with the elevator car 24' and a sensor 76 and a transmitter 78 associated with the second car 70. Each transmitter 78 may emit a distinctive pressure wave indicative of the specific car, and that may be associated with the direction of travel. An electronic device 44' is configured to recognize the variety of distinctive pressure waves and alert the person 46' accordingly.

The sensor 40 detects elevator car motion and may be configured to send a motion detected signal (see arrow 48) to the transmitter 42. The transmitter 42 is configured to receive the motion detected signal 48 and broadcast a pressure wave 50 (i.e., sonic wave) that may travel at least within the hoistway 28. The electronic device 44 may include a microphone 52 adapted to receive the pressure wave 50. The pressure wave 50 may be transmitted at a pre-scribed frequency indicative of elevator car motion and recognizable by the electronic device. Upon receipt and recognition of the pressure wave 50, the electronic device 44 is configured to alert the person 46 of the elevator car 24 motion. The alert may be of any variety including, as an example, a flashing light, a vibration, an audible alert, a written alert that appears on a screen of the electronic device, or any combination thereof. It is further contemplated and understood that the sensor 40 may be configured to output a first signal indicative of upward motion and a second signal indicative of downward motion. The transmitter 42 may then output pressure waves at two different frequencies indicative of the respective upward and downward motions.

While the present disclosure is described with reference to exemplary embodiments, it will be understood by those skilled in the art that various changes may be made and equivalents may be substituted without departing from the spirit and scope of the present disclosure. In addition, various modifications may be applied to adapt the teachings of the present disclosure to particular situations, applications, and/or materials, without departing from the essential scope thereof. The present disclosure is thus not limited to the particular examples disclosed herein, but includes all embodiments falling within the scope of the appended claims.

What is claimed is:

1. An elevator car motion alert system for signaling motion of at least one elevator car to a person, the elevator car motion alert system comprising:

a plurality of motion sensors configured to detect car motion, wherein each one is carried by a respective elevator car of the at least one elevator car;

a plurality of transmitters carried by a respective elevator car of the at least one elevator car, and each configured to broadcast a pressure wave having a predefined unique frequency specific to each one of the at least one elevator car and upon movement of a respective elevator car of the at least one elevator car and detected by a respective motion sensor of the plurality of motion sensors; and an electronic device configured to receive and process the pressure wave for alerting the person of the movement of the respective elevator car, and is configured to recognize the predefined unique frequency broadcasted by each one of the plurality of transmitters and assign the recognized unique frequency to the respective elevator car of the at least one elevator car.

2. The elevator car motion alert system set forth in claim 1, wherein the pressure wave includes a DTMF communication protocol.

* * * * *